US005107781A

United States Patent [19]

Ebeling et al.

[11] Patent Number: 5,107,781

[45] Date of Patent: Apr. 28, 1992

[54] SHIP AND ITS LOADING AND UNLOADING SYSTEM

[75] Inventors: Jaakko Ebeling, Kauniainen; Jarmo Pesonen, Espoo, both of Finland

[73] Assignee: Jaakko Poyry OY, Helsinki, Finland

[21] Appl. No.: 543,742

[22] PCT Filed: Jan. 5, 1989

[86] PCT No.: PCT/FI89/00004

§ 371 Date: Aug. 23, 1990

§ 102(e) Date: Aug. 23, 1990

[87] PCT Pub. No.: WO89/06204

PCT Pub. Date: Jul. 13, 1989

[30] Foreign Application Priority Data

Jan. 6, 1988 [FI] Finland ..... 880042

[51] Int. Cl.[5] ..... B63B 27/14; B63B 27/16

[52] U.S. Cl. ..... 114/72; 14/71.3; 414/139.4; 414/141.5; 414/143.2

[58] Field of Search ..... 114/72, 73; 414/139.4, 414/140.1, 141.5, 142.6, 143.2; 14/71.1, 71.3

[56] References Cited

U.S. PATENT DOCUMENTS 3,314,389 4/1967 Giaever-Enger et al. ..... 114/72
4,138,961 2/1979 Roper ..... 114/72

FOREIGN PATENT DOCUMENTS 113385 5/1968 Norway ..... 114/72
121768 4/1971 Norway ..... 114/72
1014691 12/1965 United Kingdom ..... 114/72

*Primary Examiner*—Sherman Basinger
*Attorney, Agent, or Firm*—Pennie & Edmonds

[57] ABSTRACT

In a cargo ship the upper edge (8) of its lateral loading opening (3) is at a higher level than the rails (4) of an overhead crane (5) in its cargo space (2), an intermediate cargo deck being divided into two sections (6, 7). The elevator section (6), farther from the opening (3), can be lowered to a lower level than the overhead crane (5) by at least the height of a cargo unit (9) and a rail section (4') located above the ramp section can be moved away from the opening. The invention is especially applicable to small ships not having an active stabilization system.

10 Claims, 4 Drawing Sheets

SHIP AND ITS LOADING AND UNLOADING SYSTEM

FIELD OF THE INVENTION

The present invention relates to a ship having at least in one of its sides an opening leading to its covered cargo space, and in particular to a loading and unloading system for such a ship, the system consisting of rails, in the top part of the cargo space, for at least one overhead crane moving in the longitudinal direction of the ship, and of an intermediate cargo deck at the opening, divided into sections and movable in the vertical direction in order to bring it into horizontal alignment with the quay. The ship according to the invention is especially suitable for use for transport of forest industry products, but it can also be used for transport of mixed cargo and bulk cargo.

BACKGROUND OF THE INVENTION

FI patent 71908 discloses a ship of the above type and its loading and unloading system, in which the side port is hinged at its lower end to form a ramp which adjoins an intermediate cargo deck which moves in the vertical direction and is divided into sections so that the ramp and the intermediate cargo deck can be aligned horizontally with the quay irrespective of its height, in which case the cargo units can be driven by a loading trailer into the cargo space of the ship to be further transferred to their final places by means of an overhead crane.

In a ship according to FI patent 71908, the cargo space is of the same height over its entire length, being, in the example case presented, of the height of at least three cargo units plus an overhead crane, in which case the height of the cargo space has to be increased by the height of one cargo unit over its entire length even if the size and stability of the ship would allow the use of only a cargo space of unincreased height, i.e. a cargo space having the height of two cargo units. However, also in the case of smaller ships the cargo space has to be made higher than this in the area adjoining the side ports, in order to enable the intermediate cargo deck to be horizontally aligned with the quay regardless of even great variations in the water level. If it is desired to improve the stability of such a ship, and specifically of a smaller ship of less than 8,000 dwt which has not been equipped with an active stabilization system and the cargo space of which is of equal height over its entire length, the upper part of the covered cargo space has to be left empty, in which case the ratio of covered cargo space to exploited cargo space remains disadvantageous. This results in harbor costs high in proportion to the cargo carried in those countries in which the total capacity of a vessel is the decisive factor in the determination of harbor-dues.

If, on the other hand, the cargo space of such a ship is made lower so that the height of the cargo space corresponds, for example, to only two cargo units plus the space required by the crane, such a system is not capable of operating in a situation in which the proportions of the quay height, ship draft, and water level vary greatly. Such situations appear in almost all harbors, and in most shiploading situations. The problem could possibly be solved by using a floating or otherwise adjustable quay, but such a solution would not be economical.

SUMMARY OF THE INVENTION

The object of the present invention is to eliminate the above-mentioned disadvantages and to provide a loading and unloading system also for smaller ships not equipped with an active stabilization system, without the cargo space having to be, over its entire length, of the same height as in the area adjoining the side ports. The invention provides a ship which can be loaded and unloaded in highly varied conditions, without the height of the cargo space having to be increased over its entire length by more than required by the operation of an overhead crane, i.e. by an amount equal to the height of the overhead crane. The present invention is especially usable in smaller ships having a capacity of less than 8,000 dwt which have not been equipped with an active stabilization system and in which it is thus not worth while to increase the height of the cargo space by more than is required by the height of an overhead crane moving on rails in the upper part of the cargo space.

The present invention is based on the idea that the height of the cargo space is increased only in the area adjoining the opening leading to it, by such an amount that the intermediate cargo deck with its ramp can be aligned horizontally with the quay regardless of the loading situation of the ship or of the water level relative to the quay, the upper edge of the opening being, however, in all circumstances at such a minimum height from the ramp section of the intermediate cargo deck that loading or unloading is possible. By contrast, the height of the rest of the cargo space is increased only by an amount equal to the height of an overhead crane.

In the system according to the invention, loading cannot be carried out when the overhead crane is at the opening, since the overhead crane is at a considerably lower level than the upper edge of the opening. However, the overhead crane can be moved away from the opening while the intermediate cargo deck is being loaded. However, in this case the overhead-crane rail closer to the opening will still remain in front of the opening. According to the invention, this problem is solved by making this rail section capable of being moved away from the opening for the duration of loading.

Also, in the system according to the invention, the overhead crane is not able to bring or take a cargo unit to the intermediate cargo deck when this deck is so high that the distance between the overhead crane and the intermediate cargo deck is smaller than the height of a cargo unit. According to the invention, this problem is solved by dividing the intermediate cargo deck into two sections successive in the loading direction, movable independently of each other in the vertical direction, and of these sections the elevator section, located farther away from the opening, is fitted to descend from the level of the ramp section, closer to the opening, to a level lower than the overhead crane by an amount at least equal to the height of a cargo unit.

The present invention thus relates to a ship, of the type referred to in the preamble, the upper edge of the opening of which is substantially at a higher level than the rails of the overhead crane, and in which the intermediate cargo deck consists of two sections located successively in the loading direction and movable independently of each other in the vertical direction, the elevator section, farther away from the opening, being fitted to descend from the level of the ramp section, closer to the opening, to a level lower than the rail level of the overhead crane by an amount at least equal to the height of a cargo unit, in addition to which the overhead-crane rail section above the ramp section is capable of being moved away from the opening at least when the elevator section rises or is already, together with the ramp section, at so high a level that the distance in the vertical direction from the level of the rail of the overhead crane is less than that required by loading.

The ramp section is preferably capable of being raised to such a height that it is immediately below the rail level, in which case the upper edge of the opening will be respectively at such a distance from it as is required by loading.

The upper edge of the opening is thus approximately at a level which is higher than the lower level of the overhead crane by an amount equal to the height of a cargo unit.

That section of the overhead-crane rail which is above the ramp section can be moved away from the opening in several different ways, but preferably it is fitted to move vertically upwards from the rail level and back in synchronization with the elevator section.

The ramp section extends horizontally through the opening from the cargo space to the quay, and its inner end is preferably articulated to an operating element movable in a substantially vertical direction in the hull of the ship, so that the ramp section can be raised pivotably inside the opening, at least when the operating element of the ramp section is in its lower position.

The pivot point of the ramp section is preferably approximately in the longitudinal center plane of the ship, especially when the cargo space is dimensioned for two adjacent cargo units.

The ramp section can be pivoted about its pivot point inside the opening by means of a lifting member which is at one end secured inside the opening in the immediate vicinity of its upper edge and at the opposite end to the outer end of the ramp section or in its vicinity.

The opening can be closed by a side port, which is preferably secured pivotably to the upper edge of the opening and may additionally be capable of being folded up.

In its lowest position the intermediate cargo deck is preferably above the bottom of the cargo space by the height of a cargo unit and at a level lower than the rail level of the overhead crane by at least the same amount, in which case the overhead-crane rail section above the ramp section need not in this situation be moved away from the opening for the duration of loading.

The covered cargo space has approximately the height of two cargo units plus an overhead crane except in the area adjoining the opening, where the cargo space has the height of at least three cargo units.

A ship according to the present invention is especially advantageous for carrying large cargo units which are equipped with ends but have open sides. In such a case the width cf the cargo space is preferably somewhat more than twice the mutual distance between the ends of a large cargo unit, so that large cargo units can be placed adjacently with their ends against each other, the open sides allowing the formation of uninterrupted spaces in the longitudinal direction of the ship, in which spaces the bottoms of the topmost large cargo units form an intermediate deck onto which, for example, vehicles can be driven.

BRIEF DESCRIPTION OF THE DRAWINGS

The invention is described below in greater detail, with reference to the accompanying drawings, in which FIG. 5 is a cross section through lines 5—5 of FIG. 2.

DETAILED DESCRIPTION

Figure 1:
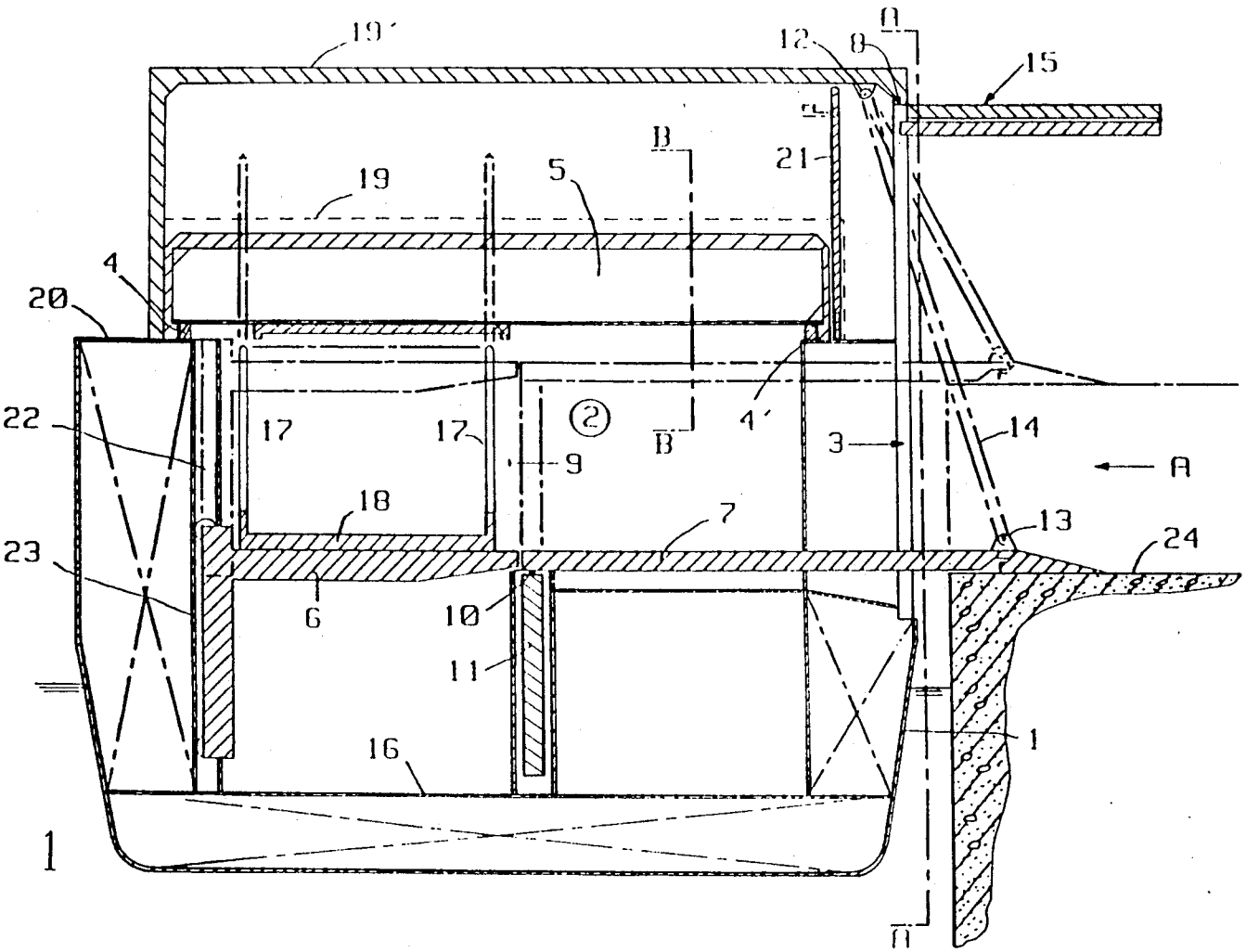
FIG. 1 depicts a ship according to the invention, in a cross section in the area of the loading and unloading opening.

The ship shown in FIG. 1 has two sides, of which one side 1 is provided with a loading and unloading opening 3, which leads into a cargo space 2 in the ship, the floor of the cargo space being indicated by reference numeral 16 and its ceiling by 19, except in the elevated part having the width of the opening 3, the ceiling of which part is indicated by 19'.

The ceiling 19 of the cargo space 2 is thus lower than the ceiling 19' of the cargo space in the area adjoining the opening 3, but at a level so much higher than the main deck 20 of the ship that an overhead crane 5 moving from one end to the other in the upper part of the cargo space 2 has room to move between the ceiling 19 of the cargo space 2 and the level of the main deck 20, along rails 4 installed at the level of the main deck 20.

In the cargo space 2 there is in the area adjoining the opening 3 additionally an intermediate deck which is made up of two sections moving independently of each other in the vertical direction, namely an elevator section 6 and a ramp section 7.

The inner end of the ramp section 7 is articulated at the pivot point 10, approximately along the center line of the ship, to an operating element 11 oriented upwards from the floor of the cargo space, and by means of this operating element the inner end of the ramp member 7 can be brought to the same level as that end of the ramp member 7 which extends out of the opening 3 to the quay, to form a substantially horizontal loading level between the quay 24 and the cargo space 2, regardless of variations of height.

Figure 3:
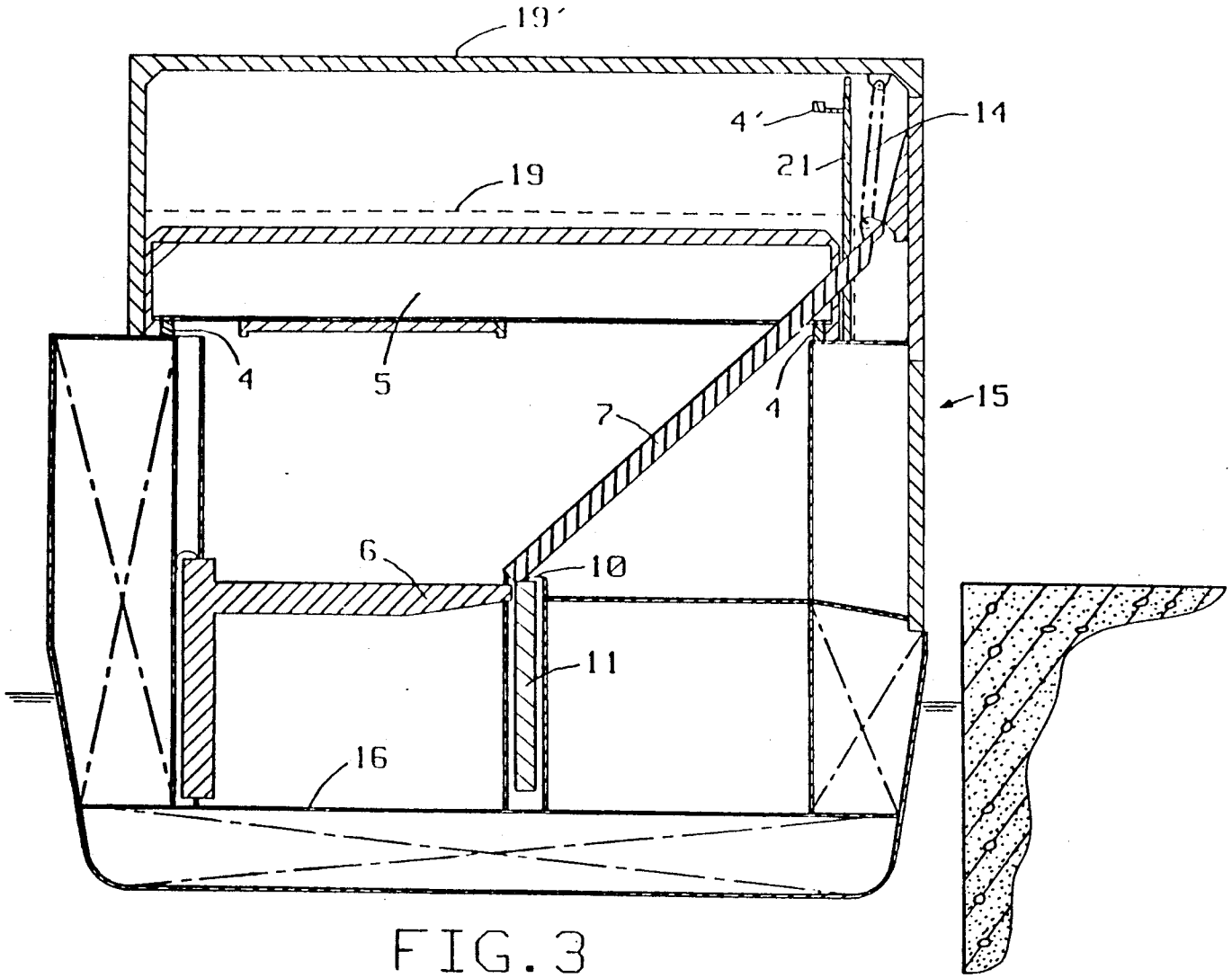
FIG. 3 is a cross section in the area of a closed opening.

The outer end of the ramp section 7 is secured to the lower end 13 of the lifting member 14, the upper end of the lifting member 14 being secured to the ceiling 19' of the cargo space 2 inside the opening 3 so that the ramp section 7 can be lifted about its pivot point 10 to a position inside the opening 3 at least when the operating element 11 is in its lowest position, as shown in greater detail in FIG. 3. Thereupon the side port 15, which is secured pivotably to the upper edge 8 of the opening and is preferably capable of being folded up, can be lowered to cover the opening 3 in order to close the cargo space 2. In this situation the overhead crane 5 moving on rails 4 has been moved away from the opening and the uplifted ramp section 7, and the separate rail section 4' of the overhead-crane rail 4 closest to the opening 3, in front of the opening 3, has been lifted, supported by vertical guide members 21, to the upper position depicted in FIG. 3, above the outer end of the unturned ramp section.

The horizontal upper position of the ramp section 7 is shown by dotted lines in FIG. 1. FIGS. 4*a–d* also show the different stages of loading, the ramp section 7 being in its horizontal upper position.

The elevator section 6 can also be moved along vertical guide members 22 fitted against the cargo space 2 side wall 23 opposite the opening 3 in such a way that the elevator section 6 can be brought to the same level as the ramp section 7 to form a continuous intermediate cargo deck in the cargo space 2. If, owing to the height of the quay 24, this level is so high that a loading unit 9 transferred onto the elevator section 6 prevents the overhead crane 5 from moving along the rails 4 to above the cargo unit 9, the elevator section 6, supported by guide members 22, can be brought lower, and preferably to its lowest position, the rail section 4', which can be raised and lowered along vertical guide members 21, being fitted to descend, in synchronization with the movement of the elevator section 6, to its lower position as a continuation of the rail 4 so that the overhead crane 5 can move to above the cargo unit 9 which is on the elevator section 6.

When the quay is low, and the ramp section 7 and the elevator section 6, which is positioned as a continuation of the ramp section, are in their lowest position, shown in FIG. 1, the cargo unit 9 can be moved from the quay 21 along the ramp section 7 to the elevator section 6 without any need for the rail section 4' to be lifted away from the opening 3, and the overhead crane can be ready and waiting for a cargo unit 9.

The operation of the loading and unloading system according to the invention is now described in greater detail with reference to FIGS. 4*a-d*.

Figure 4B:
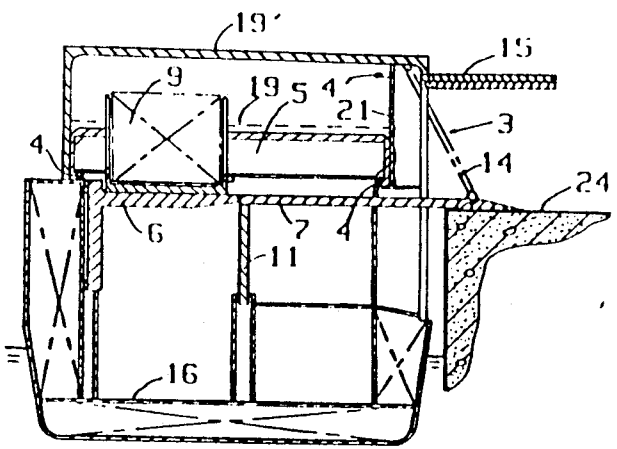
FIGS. 4*a–d* depict cross sections of a ship which is being loaded.
Figure 4D:
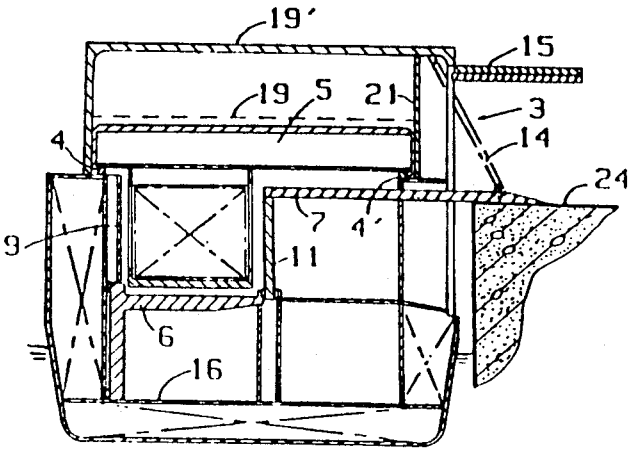
Figure 4A:
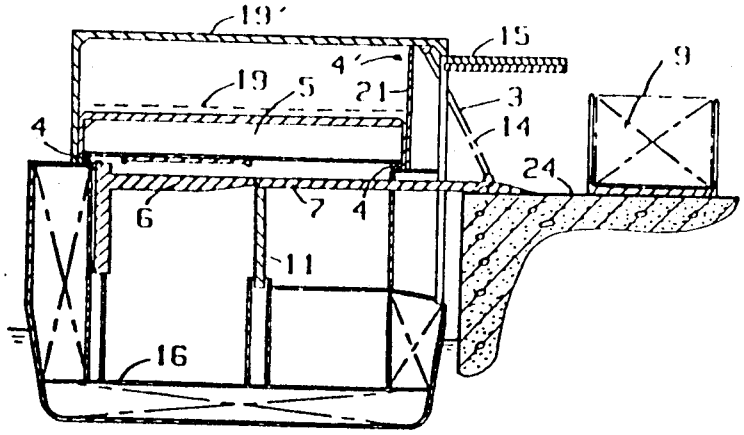

In FIG. 4*a*, the ship has arrived at a harbor, has been moored to the quay 24 and has opened its side port 15, folding in double, away from the opening 3 so that the side port 15 forms a roof in front of the opening. The operating element 11 of the ramp section 7 has, owing to the great height of the quay, been raised to its highest position, and the elevator section 6 has also been raised to its highest position to form a continuous horizontal intermediate cargo deck, while the outer end of the ramp section 7 is lowered onto the quay 24 by means of the lifting member 14. A cargo unit 9 is ready and waiting on the quay 24 and is transferred by a loading trailer (not shown) in the loading direction A from the quay 24 along the ramp section 7 to the elevator section 6 into the position shown in FIG. 4*b*.

Figure 2:
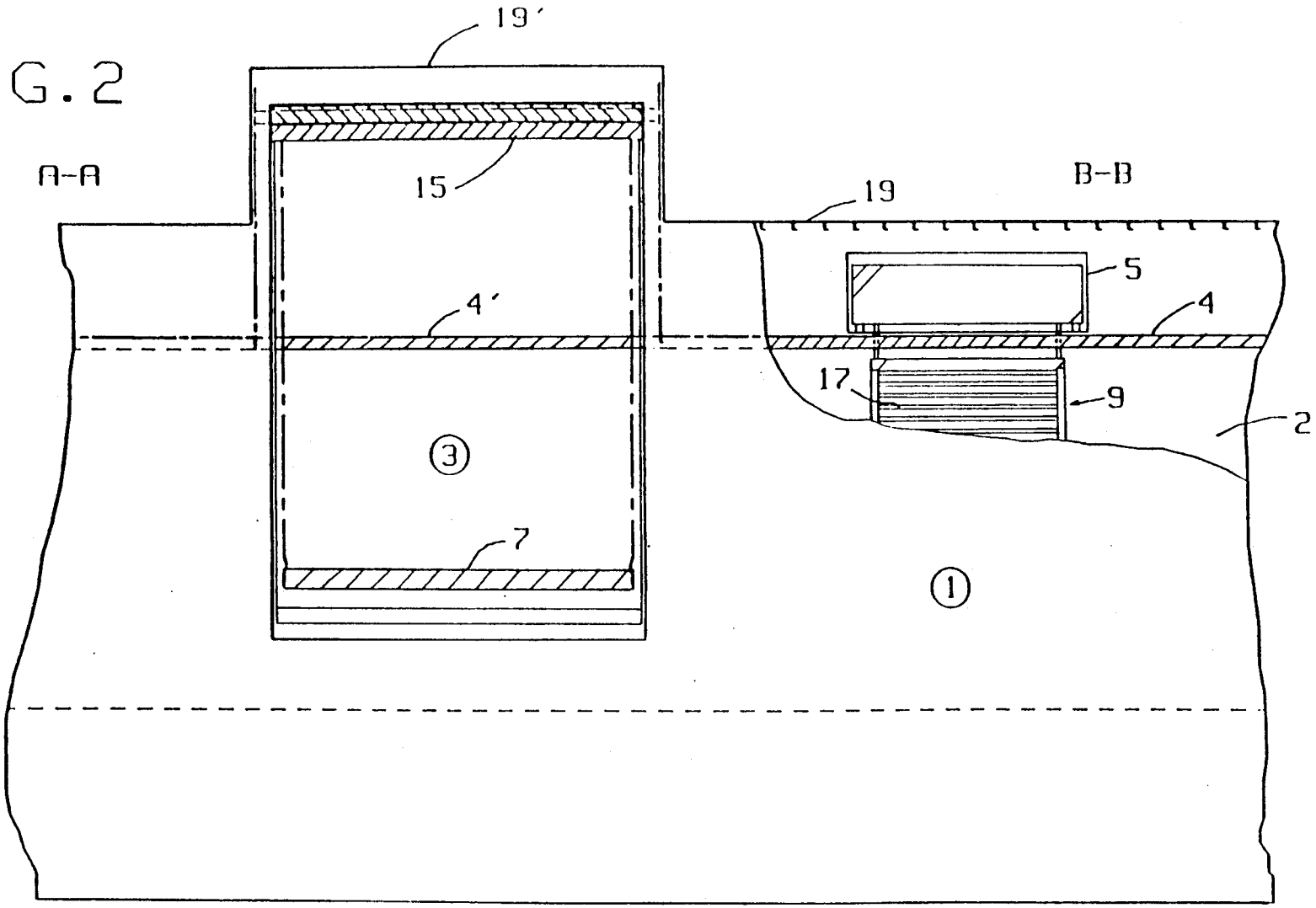
FIG. 2 is a section through lines A—A and B—B in FIG. 1.
Figure 4C:
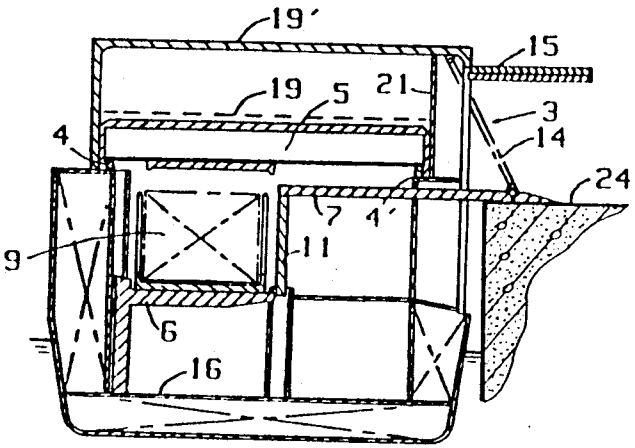

In order for the overhead crane 5 to be capable of being moved to above the cargo unit 9 to transfer the cargo unit further to its appropriate place in the cargo space, the elevator section 6 is lowered to its lowest position, shown in FIG. 4*c*, at which time the rail section 4' simultaneously descends to its lowest position as a continuation of the rail 4 closest to the side 1 so that the overhead crane 5 can be moved to above the cargo unit 9, as shown in FIG. 4*d*. Thereafter the overhead crane 5 grips the cargo unit 9 and transfers it further in the longitudinal direction of the cargo space, and possibly in its transverse direction, as shown in section B—B of FIG. 2.

The unloading of the cargo takes place in the reverse order.

For the transport, loading and unloading of bulk goods, the ship may be additionally equipped with a bulk cargo conveyor system, known per se, fitted in the upper part of the cargo space and running in the longitudinal direction of the ship, for conveying the bulk cargo to those parts of the ship's cargo space reserved for such cargo. The bulk goods conveyor system is in such a case preferably placed above the overhead crane. It is also possible to fit, to the side walls of the cargo space, rails for transverse beams and locking beams for locking cargo units in place.

A ship according to the invention can also be used for the transport of vehicles on two levels when using large cargo units 9 which are provided with ends 17 and have open sides, in which case these large-flat units are transferred into the cargo space along the ramp section 7 with one end 17 first so that the large-flat units will be in the cargo space adjacently with the ends 17 against each other so that corridors located adjacently and on top of each other and extending over the whole length of the cargo space 2 are formed in the cargo space, the bottoms 18 of the upper large-flat units forming an intermediate deck and vehicles being capable of being driven into the corridors for ship transport.

Though the cargo space 2 is depicted as having the height of two cargo units 9 plus the space required by the overhead crane 5 and the height of at least three cargo units in the area adjoining the opening 3, it is evident that the height of the cargo space can be chosen also on other grounds, provided, however, that the upper edge 8 of the opening 3 is at a substantially higher level than the rails 4 of the overhead crane 5, in order to take into account even great variations of height between the ship and the quay 24 so that loading and unloading can be carried out along a continuous, substantially horizontal intermediate cargo deck and ramp.

We claim:

1. A ship having in at least one of its sides at least one opening (3) having an upper edge and leading into a covered cargo space (2) having a floor (16), rails (4) in an upper part of the cargo space (2) and at least one overhead crane (5) movable along said rails in the longitudinal direction of the ship, an intermediate cargo deck (6, 7) in the area adjoining the opening (3), which is divided into sections and can be moved in a vertical direction to be aligned horizontally with a quay, characterized in that the upper edge (8) of the opening (3) is substantially at a higher level than the rails (4) of the overhead crane (5), the intermediate cargo deck includes two sections (6, 7) which are located successively in a loading direction (A) extending from the one opening (3) and into the cargo space and are capable of being moved independently of each other in the vertical direction, said sections including an elevator section (6) and a ramp section (7) having an outer end and an inner end, the inner end extending horizontally through the opening (3) and into the cargo space (4), the elevator section being located along said loading direction at a position farther away from the opening (3) than said ramp section, said elevator section being mounted for vertical movement from the level of the ramp section (7) to a level lower than the overhead crane (5) by an amount at least equal to the height of a cargo unit (9), and the rails (4) having a section (4') which is located above the ramp section for lifting away from the opening (3) at least when the elevator section (6) is raised or is already, together with the ramp section (7), at a level the distance of which in the vertical direction from the level of the rails (4) of the overhead crane (5) is smaller than the distance required by loading.

2. A ship according to claim 1, characterized in that in its highest position the ramp section (7) is immediately below the level of the rails and the upper edge (8) of the opening (3) is respectively at such a vertical distance from the rails as is required by loading.

3. A ship according to claim 2, characterized in that that section (4') of rails (4) for the overhead-crane (5) which is above the ramp section (7) is mounted for movement in a substantially vertical direction, synchronously with the vertical movement of the elevator section (6).

4. A ship according to claim 3, characterized in that the inner end of the ramp section (7) which extends horizontally through the opening (3) and into the cargo space (2) is articulated at a pivot point (10) to an operating element (11), said operating element being mounted for movement in a substantially vertical direction in the ship's hull in such a way that the ramp section (7) can be raised pivotably to a position inside the opening (3) at least when the ramp-section operating element (11) is in its lower position.

5. A ship according to claim 4, characterized in that the pivot point (10) at the inner end of the ramp section is approximately in the longitudinal center plane of the ship.

6. A ship according to claim 5, characterized by a lifting member (14) secured at one end (12) inside the opening (3), in the immediate vicinity of its upper edge (8), and at the opposite end (13) to the outer end of the ramp section (7) to turn the ramp section about the pivot point (10) to a position inside the opening (3).

7. A ship according to claim 6, characterized by a folding side port (15) secured pivotably to the upper edge (8) of the opening (3).

8. A ship according to claim 7, characterized in that the lower level of the intermediate cargo deck (6, 7) is at a level higher than the floor (16) of the cargo space (2) by an amount at maximum equal to the height of a cargo unit (9) and at a level lower than the level of the rails (4) of the overhead crane (5) by at least the same amount.

9. A ship according to claim 8, characterized in that the covered cargo space has a height approximately equal to the height of two cargo units (9) plus the overhead crane (5), and in the area adjoining the opening (3) approximately equal to the height of at least three cargo units (9).

10. A ship according to one of claims 1-9 for carrying large cargo units (9) provided with bottoms (18) and ends (17) but having open sides, characterized in that the width of the cargo space (2) is somewhat greater than the mutual distance between the ends (17) of a large cargo unit, multiplied by the number of units to be placed adjacently, in order to place large cargo units (9) adjacently with their ends against each other, the open sides allowing the formation of continuous spaces in the longitudinal direction of the ship, the bottoms (18) of the upper large cargo units (9) forming an intermediate deck.

* * * * *